United States Patent [19]

Andersson et al.

[11] 4,049,302

[45] Sept. 20, 1977

[54] SAFETY LOCK MECHANISM

[75] Inventors: Henry Veine Andersson; Sven Vilhelm Eriksson, both of Goteborg, Sweden

[73] Assignee: AB Telekontroll, Goteborg, Sweden

[21] Appl. No.: 639,161

[22] Filed: Dec. 9, 1975

[30] Foreign Application Priority Data

Dec. 12, 1974 Sweden ..... 7415589

[51] Int. Cl.[2] ..... E05C 19/16

[52] U.S. Cl. ..... 292/201; 292/251.5

[58] Field of Search ..... 292/78, 201, 341.16, 292/251.5, 144, DIG. 72

[56] References Cited

U.S. PATENT DOCUMENTS

| | | | |
|---|---|---|---|
| 1,344,508 | 6/1920 | Hagstrom | 292/78 |
| 2,673,755 | 3/1954 | Asp | 292/251.5 X |
| 2,871,676 | 2/1959 | Miller et al. | 292/251.5 X |
| 3,129,968 | 4/1964 | Graham | 292/201 |

FOREIGN PATENT DOCUMENTS

| | | | |
|---|---|---|---|
| 693,564 | 7/1953 | United Kingdom | 292/251.5 |

*Primary Examiner*—Richard E. Moore

*Attorney, Agent, or Firm*—Brumbaugh, Graves, Donohue & Raymond

[57] ABSTRACT

In a safety lock mechanism, including a locking bolt pivotable about a door hinge so as to be able to swing to a door-locking position and an electromagnet provided to retain said bolt in said door-locking position, apparatus arranged, so that upon the interruption of current supplied to said electromagnet and the application of a force on the door leaf to open the door, said bolt is urged to pivot to a door-releasing position, thus ensuring that the door is openable under all circumstances, even when considerable pressure is exerted thereon, such as e.g. from crowds of people in a panic.

4 Claims, 9 Drawing Figures

SAFETY LOCK MECHANISM

BACKGROUND OF THE INVENTION

The present invention concerns an improved safety lock mechanism e.g. for doors.

In public premises designed to hold a large number of people it is imperative — and in some countries obligatory and expressly required by the fire department chief or corresponding authority — that all entrances and exits be arranged to be quickly and easily opened simultaneously, or nearly simultaneously, in the event of fire or other danger.

To eliminate the necessity of keeping a large number of service personnel in attendance to watch all entrances and exits, the number of which in some cases, such as in sports arenas, may be considerable, electrically controllable locking mechanisms have been installed. A large variety of such locking mechanisms are available and in principle they all function through cooperation between a locking bar and an electromagnet, for instance, in such a way that when an electromagnet is energized. it activates the locking bar so as to move the latter in the axial direction from its door-locking position in engagement with a door frame to its door-opening position. Consequently, one single switch may control any number of doors to unlock them all simultaneously.

However, mechanisms of this kind suffer from serious drawbacks. In the event that a rapidly developing accident, such as an explosive fire, occurs in public premises holding a large number of persons, the persons inside easily panic. Crowds of people will then rush towards the exits. If the latter are not already unlocked, the masses of people will exert such a pressure on the doors that the locking bars is prevented from moving to the door-opening position because of the large amount of friction created between the locking bars and the door frame even if eventually it is possible to force the doors open, the opening thereof will nevertheless be considerably delayed and the evacuation of the premises will take place at a pace that is unsatisfactorily low, resulting in the evident jeopardising of people's lives.

SUMMARY OF THE PRESENT INVENTION

The present invention provides a safety lock mechanism which has its primary merits in situations of the kind outlined above and wherein the earlier drawbacks referred to are eliminated. The invention more precisely concerns a bolt which is provided on the door leaf or door frame and which is pivotable about a hinge arranged adjacent the gap between the door leaf and the door frame, so s to be able to swing to a position wherein it bridges said gap, and an electromagnet provided in or on the door leaf or the door frame and arranged to retain the bolt in a door-locking position. The invention is characterised in that upon interruption of the current supplied to the electromagnet and the application of a force on the door leaf to open the door, the door frame or the door leaf or a means secured on the door frame or the door leaf and serving as a counter support, is arranged to press against the bolt, urging the latter to pivot to a position wherein the door is released.

In accordance with one embodiment of the invention the electromagnet has its contacting surface positioned in the plane of the door leaf and the bolt extends in its door-locking position along a straight line across the door gap along the surface of attraction of the electromagnet.

In accordance with another embodiment the electromagnet has its contacting surface positioned essentially at right angles, outward and away from the frame or the door leaf, and directed towards the door leaf or the frame. In this case, the bolt has an angular configuration and is comprised of a first section which, when the bolt is in its door-locking position, extends from the hinge across the door gap somewhat in over the frame or the door leaf, and a second section which extends essentially at right angles outward and away from the frame or the door leaf along the surface of attraction of the electromagnet.

Both embodiments provide the advantage that the bolt cannot unintentionally prevent a door from being opened, once the current to the electromagnet is interrupted.

BRIEF DESCRIPTION OF THE DRAWINGS

The invention will be described in more detail in the following specification with reference to the accompanying drawings, wherein.

DETAILED DESCRIPTION OF A PREFERRED EMBODIMENT

Figure 1:
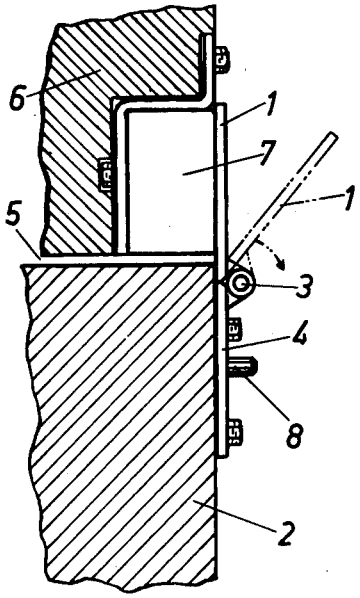
FIG. 1 shows a section through a portion of a door leaf and a door frame provided with the mechanism in accordance with the invention.
Figure 4:
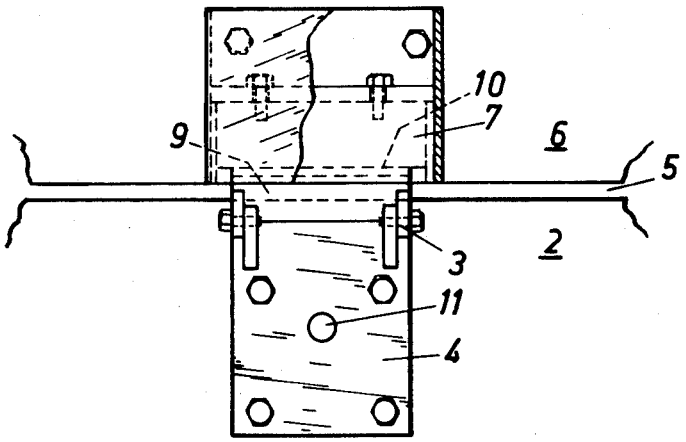
FIG. 4 is a view of the mechanism in accordance with FIG. 2 as seen from the front.

FIG. 1 illustrates one embodiment according to which the locking bolt is in the form of a flat blade 1. The blade is pivotable about a hinge 3 secured to a plate 4 mounted to a door leaf 2. The hinge 3 is positioned closely adjacent a gap 5 intermediate the door leaf 2 and the frame 6 therefor. An electromagnet 7 is arranged in countersunk position in the frame 6, the surface of attraction of said magnet facing outwards and positioned flush with the inner face of the door leaf 2. A pin 8 provided on the plate 4 forms a spacer means preventing the bolt from coming into close contact with the plate in the swung-away position of the bolt.

Figure 2:
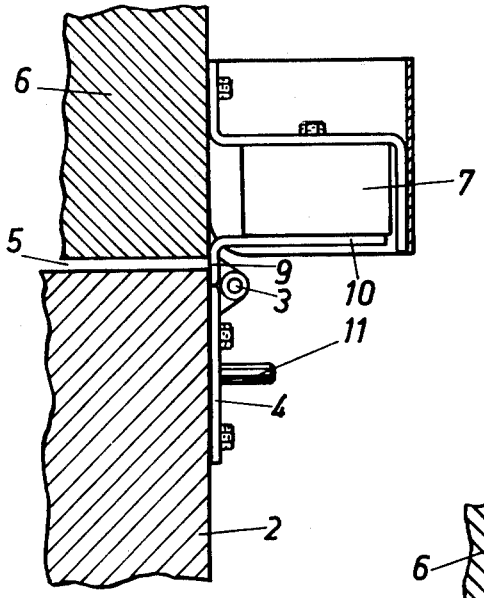
FIG. 2 is a similar sectional view but illustrating another embodiment of the mechanism in locked position.
Figure 3:
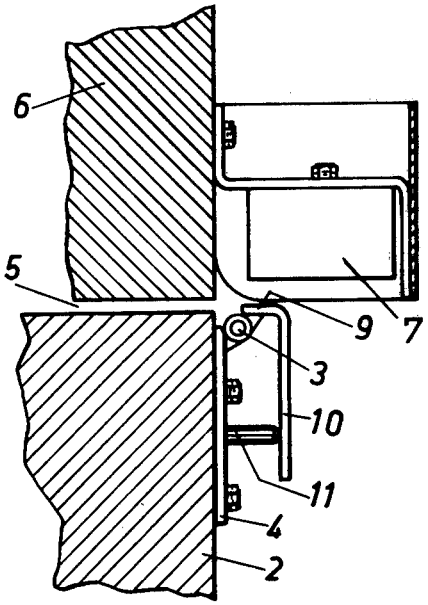
FIG. 3 illustrates the same view as FIG. 2 but shows the mechanism in open position.

FIG. 2 illustrates another embodiment the function of which is identical with that illustrated in FIG. 1. In this case, the electromagnet 7 is positioned on the external face of the frame 6 and its surface of attraction extends at right angles or nearly at right angles relative to the plane of the door leaf 2. The bolt is bent at an angle and comprises a first section 9 which, in the locking position of the bolt, extends from the hinge 3 across the gap 5 and slightly in over the frame 6, and a second section 10 which extends essentially at right angles outward and away from the frame along the surface of attraction of the electromagnet 7. Also in this case a pin 11 is arranged on the plate 4 against which pin section 10 abuts when the bolt is in its swung-away position.

Figure 5:
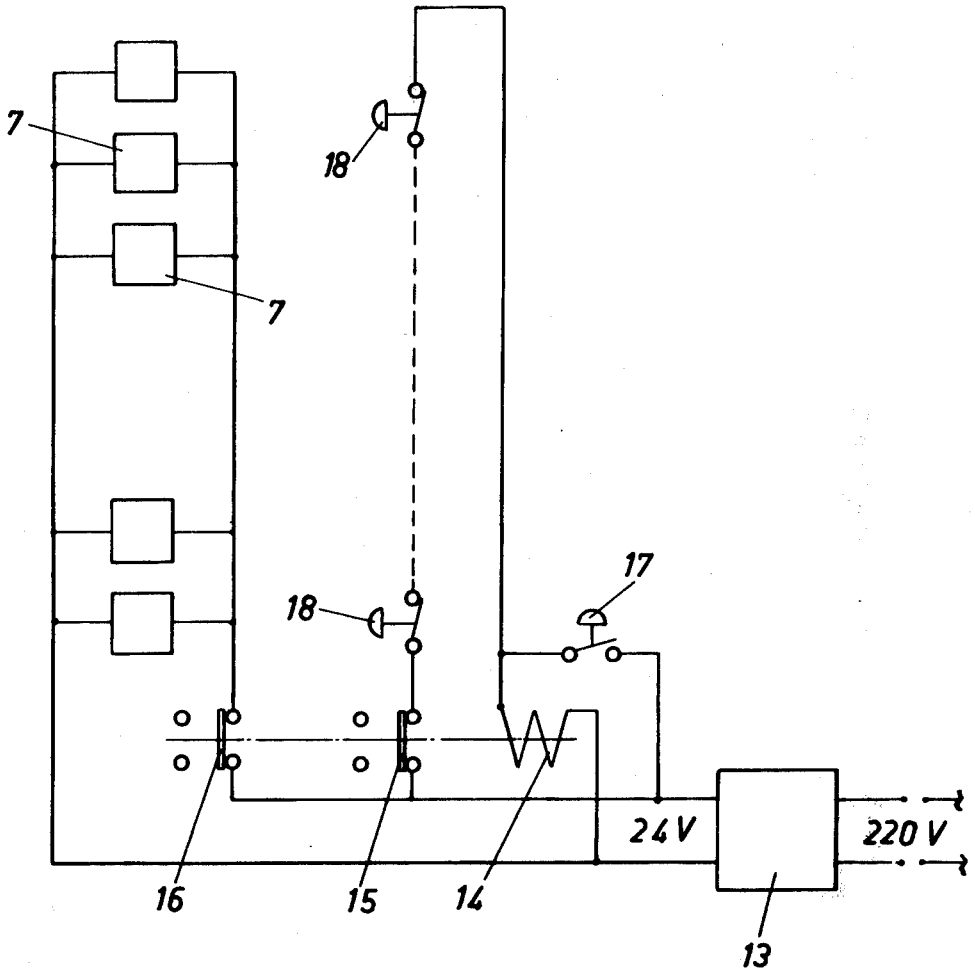
FIG. 5 is a wiring diagram including the mechanism in accordance with the invention.

FIG. 5 illustrates a wiring (block) diagram comprising a series of electromagnets 7. The coupling is intended to be used in public premises having a large number of entrance doors 2, see FIG. 6, each one of which is equipped with a safety lock mechanism 12 in accordance with the subject invention. The wiring system comprises a transformer 13 by means of which the net voltage of 220 V is reduced to preferably 24V. To the low-voltage side is connected a relay 14 having two relay contacts 15 and 16. Between the relay 14 and the transformer 13 is coupled a pressure switch 17.

In parallel with the circuit in which the above-mentioned means are included, the relay 14 forms a circuit together with one of the relay contact 15 which contact forms a holding contact for the relay, and an arbitrary number of switches 18 which preferably are positioned at strategic points in the premises.

To the transformer 13 is futhermore connected in parallel a circuit comprising the other contact 16 of the relay 14 and all the electromagnets 7, interconnected in parallel.

All of the doors 2 are equipped with ordinary locking mechanisms 19 of some known kind. Before an event all of the doors are locked in the conventional manner except those used as entrances. As soon as a large number of persons has been admitted into the premises, the service personnel operate the pressure switch 17, whereby the relay 14 is activated to close the two contacts 15 and 16. When the switch 17 is released, the contact 15 keeps the relay active. The contact 16 thus also is kept closed, which means that all electromagnets 7 are energized. The service personnel thereafter walk around to all of the doors 2 and lifts the bolt (1 or 9, 10) into magnetic contact with the electromagnets 7 and unlock the ordinary locks 19 FIG. 6.

Figure 6:
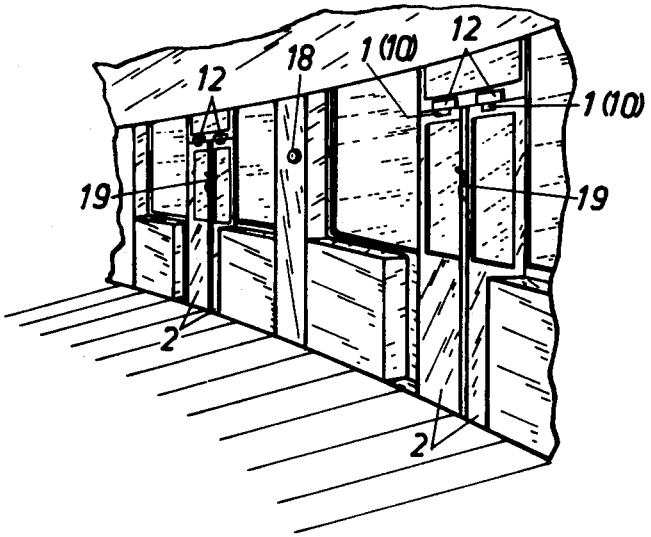
FIG. 6 is an interior view of a vestibule.

All of the doors 2 thus still remain locked. A visitor is unable to open any door, either from the inside or from the outside. However, in case of an accident inside the premises of such a character that the premises must be evacuated quickly, the service personnel immediately operate the nearest pressure switch 18. In FIG. 6 a switch 18 of this kind is shown for the sake of simplicity positioned between two doors, but in reality these switches should be positioned at strategc locations, i.e. easily accessible to the service personnel but out of reach of the public in order to prevent misuse of the safety lock mechanism.

As soon as one or some of the switches 18 are activated, the relay 14 drops thus de-energizing of the electromagnets 7 simultaneously. Normally, the bolts will then loose their contact with their associated electromagnet and fall down, whereby the doors are free to be opened. The great value of the invention, however, lies in the fact that even if the crowds of people have had time already before the current is interrupted, to build up a pressure against the door before the current is interrupted or if, after the current interruption, one or several bolts on account of inertia in the hinge 3 and remanence in the electromagnet 7 remain in the locking position, it is still possible to force the doors open rapidly, owing to the position of the hinge 3 closely adjacent the door gap 5.

Figure 8:
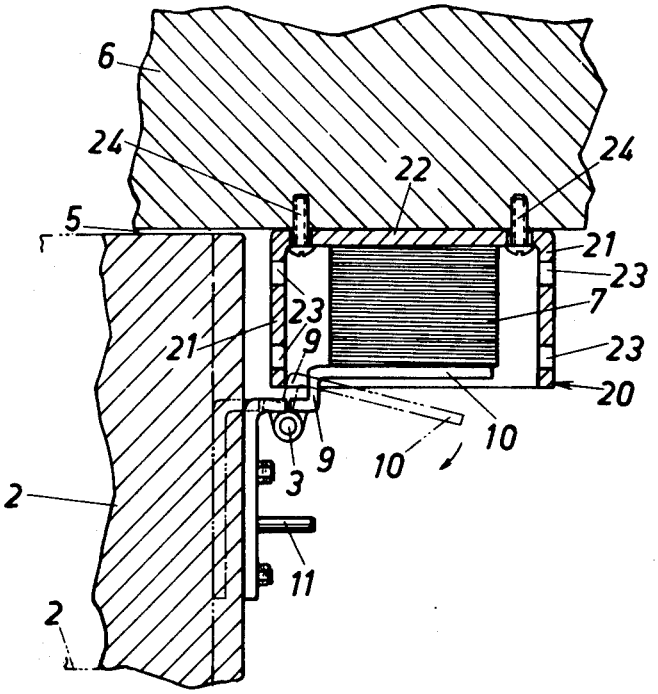
FIGS. 8 and 9 are sectional views similar to FIGS. 1-3 but illustrating alternative embodiments.
Figure 9:
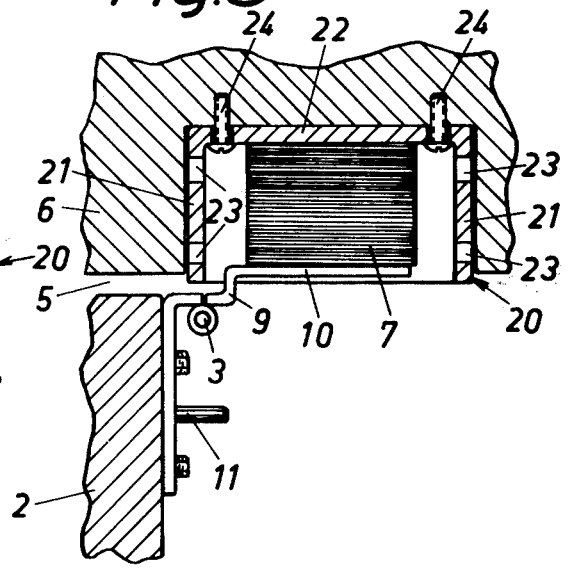
Figure 7:
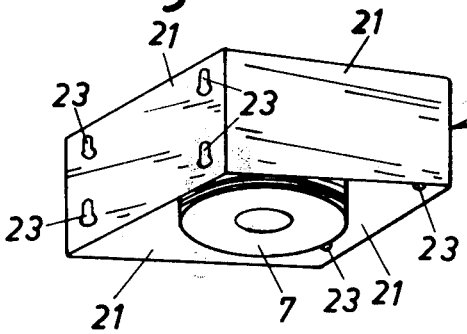
FIG. 7 is a perspective view of a detail of the mechanism.

FIGS. 7 to 9 show how a standard arrangement according to the invention fits any door by positioning the electromagnet 7 in a box-like housing 20 comprising four side sections 21 and a top section 22 and provided with apertures 23 to accommodate attachment screws 24. The apertures 23 are preferably pear-shaped, making it possible initially to secure screws 24 at the intended places in the frame 6 or the door leaf 2 and thereafter push the screw heads through the wider portion of the apertures 23 and thus hook the housing 20 securely in place FIG. 8 illustrates an embodiment according to which the housing 20 including the electromagnet 7 is mounted in a suspended position from the lower surface of a frame 6, and FIG. 9 illustrates an embodiment according to which the housing including the electromagnet is provided in a counter-sunk position in the lower face thereof. In both cases, the bolt (9, 10) will move to the left relative to the drawings when the door 2 is opened to the left and will come into engagement with one of the side sections 21 instead of with the frame 6. This side section 21 thus will serve as a counter-support to the bolt (9, 10) and will ensure that the bolt swings downwards, as illustrated by the dash-and-dot lines in FIG. 8.

The embodiments as illustrated in FIGS. 2 to 4, 8 and 9 are all advantageous considering the cooperation of forces between the bolt (9, 10) and the electromagnet 7 and their positions relative to the door leaf 2. Should anyone shake the door violently for the purpose of generating vibrations that are sufficiently strong to release section 10 of the bolt from its contact with the electromagnet 7, this attempt will fail, because the forces to which the bolt is exposed on the whole will be aligned with the bolt section 10. Consequently, the risk is negligible that vibrations,, even if they are powerful, will be able to generate such a large air gap between the bolt section 10 and the electromagnet 7 that the bolt will drop.

The coupling in FIG. 5 is such that in case the main current supply to the premises (building) is interrupted, the relay 14 drops, the electromagnets are de-energized and thus the doors 2 become openable. This is essential in this connection, as many persons, when they experience total black-out among large crowds of people, panic easily. In addition, it might be difficult under such circumstances to reach a pressure switch 18 rapidly, for which reason automatic unlocking of the doors 2 is a considerable advantage.

The invention is not limited to the embodiments as shown and illustrated but it may be modified in a variety of ways within the scope of the appended claims. The shape of the bolt may be different and the position of the electromagnet 7 and that of the bolt may also differ from those shown. For instance, the two details may change place, i.e. the bolt may be provided on the frame 6 and the electromagnet 7 on the door leaf 2, which position is most easily understood if the sheets on which drawing FIGS. 1 to 3 and 8 to 9 are shown turned upside down. In this position, it might be advantageous to connect the bolt to a traction spring pulling the bolt upwards, as soon as the electromagnet is de-energized.

What we claim is:

1. An improved safety lock mechanism for a door having a door leaf part and a door frame part separated by a gap, comprising:

a bolt pivotally mounted on one of said door parts adjacent said gap so as to be able to swing into a door-locking position wherein it bridges said gap, said bolt having an angular configuration and being comprised of a first section and a substantially longer second section, the first and second sections being rigidly connected together essentially at right angles, when in the door-locking position the first section being essentially parallel to the surface of the one door part and located closer to the surface of the one door part than is the second section, the first section extending across the gap toward said other door part;

an electromagnet provided with an interruptable supply of current and being mounted on the other of said door parts so as to be able to retain said bolt in the door-locking position, the surface of attraction of said electromagnet being directed toward said one door part and being positioned so as to extend outwardly away from the other door part essentially at right angles to said other door part, the second section of the bolt extends essentially at right angles outwardly away from the other door part along the surface of attraction of said electromagnet when the bolt is in the door-locking position; and release means, connected to the other of said door parts and intercepting the first section of said bolt when in its door-locking position, for pressing against the first section of said bolt upon the application of a force on the door leaf to open the door, said release means securely locking the door closed when current is supplied to said electromagnet and urging the bolt to pivot into a position releasing said door upon the interruption of current supplied to said electromagnet.

2. An improved safety lock mechanism according to claim 1, wherein said bolt is mounted on said door leaf part and said electromagnet is mounted on said door frame part.

3. An improved safety lock mechanism according to claim 2, wherein said release means serves as a counter support for said bolt when the door is opened and comprises one of said door frame or a member attached to said door frame.

4. An improved safety lock mechanism according to claim 1, wherein said bolt is mounted on said door frame part and said electromagnet is mounted on said door leaf part.

* * * * *